US009293814B2

(12) United States Patent
Ozden

(10) Patent No.: US 9,293,814 B2
(45) **Date of Patent: *Mar. 22, 2016**

(54) HEARING AID WITH AN ANTENNA

(75) Inventor: Sinasi Ozden, Rodovre (DK)

(73) Assignee: GN RESOUND A/S, Ballerup (DK)

( * ) Notice: Subject to any disclaimer, the term of this patent is extended or adjusted under 35 U.S.C. 154(b) by 770 days.

This patent is subject to a terminal disclaimer.

(21) Appl. No.: 13/271,170

(22) Filed: Oct. 11, 2011

(65) Prior Publication Data

US 2012/0093324 A1 Apr. 19, 2012

(30) Foreign Application Priority Data

| | | |
|---|---|---|
| Oct. 12, 2010 | (DK) | 2010 00931 |
| Apr. 7, 2011 | (DK) | 2011 00273 |
| Jul. 15, 2011 | (DK) | 2011 70393 |

(51) Int. Cl.

| | |
|---|---|
| ***H04R 25/00*** | (2006.01) |
| ***H01Q 1/36*** | (2006.01) |
| ***H01Q 1/27*** | (2006.01) |
| ***H01Q 9/42*** | (2006.01) |

(52) U.S. Cl.

CPC ..... *H01Q 1/36* (2013.01); *H01Q 1/273* (2013.01); *H01Q 9/42* (2013.01); *H04R 25/552* (2013.01); *H04R 25/554* (2013.01); *H04R 2225/51* (2013.01)

(58) Field of Classification Search

USPC ..... 381/23.1, 311, 315

See application file for complete search history.

(56) References Cited

U.S. PATENT DOCUMENTS

| | | | |
|---|---|---|---|
| 2,535,063 | A | 12/1950 | Halstead |
| 3,276,028 | A | 9/1966 | Mayes et al. |
| 4,334,315 | A | 6/1982 | Ono et al. |
| 4,924,237 | A | 5/1990 | Honda et al. |
| 5,621,422 | A | 4/1997 | Wang |
| 5,721,783 | A | 2/1998 | Anderson |
| 5,760,746 | A | 6/1998 | Kawahata |
| 5,761,319 | A | 6/1998 | Dar et al. |
| 6,515,629 | B1 | 2/2003 | Kuo |

(Continued)

FOREIGN PATENT DOCUMENTS

| | | | |
|---|---|---|---|
| CN | 1684549 | A | 10/2005 |
| CN | 101835082 | A | 9/2010 |

(Continued)

OTHER PUBLICATIONS

Conway, Gareth, "Antennas for Over-Body-Surface Communication at 2.45 Ghz" Apr. 4, 2009.*

(Continued)

*Primary Examiner* — Davetta W Goins
*Assistant Examiner* — Amir Etesam
(74) *Attorney, Agent, or Firm* — Vista IP Law Group, LLP

(57) ABSTRACT

A hearing aid includes a housing, and a hearing aid assembly accommodated in a housing, the hearing aid assembly having a first antenna element configured for emission of an electromagnetic field, and a second antenna element comprising a first section and a parasitic antenna element, wherein the first antenna element, the first section, and the parasitic antenna element are configured so that a total electromagnetic field emitted from the hearing aid assembly is substantially the same irrespective of whether the housing is worn in its operational position on a right hand side or a left hand side of a user.

25 Claims, 8 Drawing Sheets

(56) References Cited

U.S. PATENT DOCUMENTS

Figure 1:
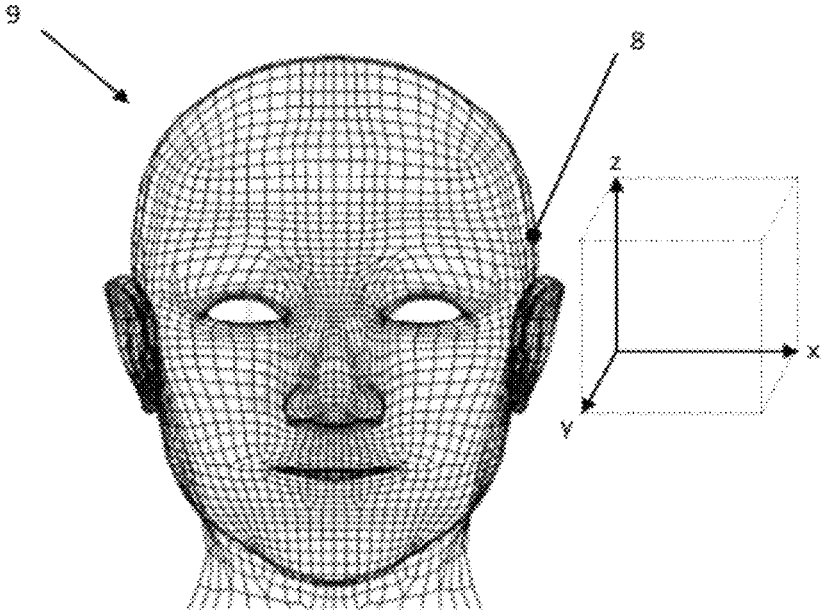

| | | | | |
|---|---|---|---|---|
| 7,002,521 | B2 | 2/2006 | Egawa et al. | |
| 7,154,442 | B2 | 12/2006 | Van Wonterghem et al. | |
| 7,256,747 | B2 | 8/2007 | Victorian et al. | |
| 7,446,708 | B1 | 11/2008 | Nguyen et al. | |
| 7,570,777 | B1 | 8/2009 | Taenzer et al. | |
| 7,593,538 | B2 | 9/2009 | Polinske | |
| 7,652,628 | B2 | 1/2010 | Zweers | |
| 7,791,551 | B2 * | 9/2010 | Platz | H01Q 1/085 343/718 |
| 7,978,141 | B2 | 7/2011 | Chi et al. | |
| 8,494,197 | B2 | 7/2013 | Polinske et al. | |
| 2004/0080457 | A1 | 4/2004 | Guo | |
| 2004/0246179 | A1 | 12/2004 | Chen et al. | |
| 2005/0068234 | A1 | 3/2005 | Hung et al. | |
| 2005/0094840 | A1 | 5/2005 | Harano | |
| 2005/0099341 | A1 * | 5/2005 | Zhang | H01Q 1/273 343/700 MS |
| 2005/0244024 | A1 | 11/2005 | Fischer et al. | |
| 2005/0248717 | A1 | 11/2005 | Howell et al. | |
| 2006/0012524 | A1 | 1/2006 | Mierke et al. | |
| 2006/0018496 | A1 | 1/2006 | Niederdrank et al. | |
| 2006/0061512 | A1 | 3/2006 | Asano et al. | |
| 2006/0071869 | A1 | 4/2006 | Yoshino et al. | |
| 2006/0115103 | A1 | 6/2006 | Kvist | |
| 2006/0181466 | A1 | 8/2006 | Krupa | |
| 2006/0192723 | A1 | 8/2006 | Harada et al. | |
| 2007/0080889 | A1 | 4/2007 | Zhang | |
| 2007/0171134 | A1 | 7/2007 | Yoshino et al. | |
| 2007/0229369 | A1 | 10/2007 | Platz | |
| 2007/0229376 | A1 | 10/2007 | Desclos et al. | |
| 2007/0230714 | A1 | 10/2007 | Armstrong | |
| 2007/0285321 | A1 | 12/2007 | Chung | |
| 2008/0024375 | A1 | 1/2008 | Martin et al. | |
| 2008/0056520 | A1 | 3/2008 | Christensen et al. | |
| 2008/0079645 | A1 | 4/2008 | Higasa et al. | |
| 2008/0231524 | A1 | 9/2008 | Zeiger et al. | |
| 2009/0074221 | A1 | 3/2009 | Westermann | |
| 2009/0196444 | A1 | 8/2009 | Solum | |
| 2009/0231204 | A1 | 9/2009 | Shaker et al. | |
| 2009/0231211 | A1 | 9/2009 | Zweers | |
| 2009/0243944 | A1 | 10/2009 | Jung et al. | |
| 2009/0273530 | A1 | 11/2009 | Chi et al. | |
| 2009/0315787 | A1 | 12/2009 | Schatzle | |
| 2010/0020994 | A1 | 1/2010 | Christensen et al. | |
| 2010/0033380 | A1 | 2/2010 | Pascolini et al. | |
| 2010/0158291 | A1 | 6/2010 | Polinske | |
| 2010/0158293 | A1 * | 6/2010 | Polinske | H01Q 1/243 381/315 |
| 2010/0158295 | A1 | 6/2010 | Polinske et al. | |
| 2010/0172525 | A1 | 7/2010 | Angst et al. | |
| 2010/0245201 | A1 | 9/2010 | Hossain et al. | |
| 2010/0321269 | A1 | 12/2010 | Ishibana et al. | |
| 2011/0007927 | A1 | 1/2011 | Hedrick et al. | |
| 2011/0022121 | A1 | 1/2011 | Meskins | |
| 2011/0129094 | A1 | 6/2011 | Petersen | |
| 2011/0294537 | A1 | 12/2011 | LaDell | |
| 2012/0087506 | A1 | 4/2012 | Ozden | |
| 2012/0093324 | A1 | 4/2012 | Sinasi | |
| 2012/0154222 | A1 | 6/2012 | Oh et al. | |
| 2013/0308805 | A1 | 11/2013 | Ozden | |
| 2014/0010392 | A1 | 1/2014 | Kvist | |
| 2014/0185848 | A1 | 7/2014 | Ozden et al. | |
| 2014/0321685 | A1 | 10/2014 | Rabel | |

FOREIGN PATENT DOCUMENTS

| | | | |
|---|---|---|---|
| DE | 3625891 | A1 | 2/1988 |
| DE | 10 2004 017832 | | 10/2005 |
| DE | 10 2008 022 127 | A1 | 11/2009 |
| EP | 1 231 819 | A2 | 8/2002 |
| EP | 1294049 | A1 | 3/2003 |
| EP | 1 465 457 | A2 | 10/2004 |
| EP | 1 465 457 | A3 | 10/2004 |
| EP | 1 589 609 | | 10/2005 |
| EP | 1 594 188 | A1 | 11/2005 |
| EP | 1 681 903 | A2 | 7/2006 |
| EP | 1 763 145 | A1 | 3/2007 |
| EP | 1939984 | A1 | 2/2008 |
| EP | 1 953 934 | A1 | 8/2008 |
| EP | 2 200 120 | A2 | 6/2010 |
| EP | 2 200 120 | A3 | 6/2010 |
| EP | 2 207 238 | | 7/2010 |
| EP | 2 229 009 | A1 | 9/2010 |
| EP | 2 302 737 | | 3/2011 |
| EP | 2 458 674 | A2 | 5/2012 |
| EP | 2637251 | A1 | 11/2013 |
| EP | 2 680 366 | | 1/2014 |
| EP | 2 723 101 | A2 | 4/2014 |
| EP | 2 723 101 | A3 | 4/2014 |
| EP | 2 765 650 | | 8/2014 |
| JP | S59-97204 | | 6/1984 |
| JP | H10-209739 | | 8/1998 |
| JP | 2005-304038 | A | 10/2005 |
| JP | 2006025392 | | 1/2006 |
| JP | 2006-033853 | A | 2/2006 |
| JP | 2012-090266 | | 5/2012 |
| WO | WO 98/44762 | | 10/1998 |
| WO | WO 03/026342 | | 3/2003 |
| WO | WO 2004/110099 | A2 | 12/2004 |
| WO | WO 2005/076407 | A2 | 8/2005 |
| WO | 2005/081583 | A1 | 9/2005 |
| WO | WO 2006/055884 | A2 | 5/2006 |
| WO | WO 2006122836 | A2 | 11/2006 |
| WO | WO 2007/045254 | A1 | 4/2007 |
| WO | WO 2007/140403 | A2 | 6/2007 |
| WO | 2008012355 | A1 | 1/2008 |
| WO | WO 2009/010724 | A1 | 1/2009 |
| WO | 2009/098858 | A1 | 8/2009 |
| WO | WO 2009/098858 | A1 | 8/2009 |
| WO | WO 2009117778 | A1 | 10/2009 |
| WO | WO 2010/065356 | A1 | 6/2010 |
| WO | WO 2011099226 | | 8/2011 |
| WO | WO 2012059302 | | 5/2012 |
| WO | WO 2014090420 | A1 | 6/2014 |

OTHER PUBLICATIONS

1st Technical Examination and Search Report dated Jan. 25, 2013 for DK Patent Application No. PA 2012 70412, 4 pages.

1st Technical Examination and Search Report dated Jan. 24, 2013 for DK Patent Application No. PA 2012 70411, 5 pages.

Second Technical Examination dated Aug. 6, 2013 for DK Patent Application No. PA 2012 70411, 2 pages.

Second Technical Examination—Intention to Grant dated Jul. 8, 2013 for DK Patent Application No. PA 2012 70412, 2 pages.

Non-final Office Action dated Jan. 2, 2014 for U.S. Appl. No. 13/740,471.

Third Danish Office Action dated Oct. 17, 2012 for Danish Patent Application No. PA 2010 00931.

First Office Action dated Feb. 12, 2013 for Japanese Patent Application No. 2011-224711.

Fourth Danish Office Action , Intention to Grant dated Feb. 13, 2013 for Danish Patent Application No. PA 2010 00931.

Danish Office Action for Danish Patent Application No. PA 2011 70566.

Notice of Reasons for Rejection dated May 21, 2013 for Japanese Patent Application No. 2011-224705.

First Technical Examination and Search Report Dated Jan. 18, 2013 for DK Patent Application No. PA 2012 70410, 4 pages.

Second Technical Examination dated Jul. 12, 2013, for DK Patent Application No. PA 2012 70410, 2 pages.

Third Technical Examination dated Jan. 31, 2014, for DK Patent Application No. PA 2012 70410, 2 pages.

First Danish Office Action dated Apr. 26, 2011, for Danish Patent Application No. PA 2010 00931.

Second Danish Office Action dated Apr. 24, 2012, for Danish Patent Application No. PA 2010 00931.

Danish Office Action dated May 1, 2012 for Danish Patent Application No. PA 2011 70567.

English Abstract of Foreign Reference DE 10 2008 022 127 A1.

(56) References Cited

OTHER PUBLICATIONS

Non-final Office Action dated Oct. 8, 2013 for U.S. Appl. No. 13/271,180.
Chinese Office Action and Search Report dated Nov. 12, 2013 for related CN Patent Application No. 201110317264.6.
Chinese Office Action and Search Report dated Dec. 4, 2013 for related CN Patent Application No. 201110317229.4.
Final Office Action dated Feb. 27, 2014, for U.S. Appl. No. 13/271,180.
Extended European Search Report dated Mar. 7, 2014 for EP Patent Application No. 11184507.9.
Advisory Action dated Aug. 29, 2014 for U.S. Appl. No. 13/740,471.
Extended European Search Report dated May 14, 2014 for EP Patent Application No. 13192322.9.
Final Office Action dated Aug. 29, 2014 for U.S. Appl. No. 13/848,605.
First Technical Examination and Search Report dated Jun. 26, 2014 for DK Patent Application No. PA 2013 70667, 5 pages.
Office Action dated Jun. 17, 2014 in Japanese Patent Application No. 2013-258396, 3 pages.
First Technical Examination dated Jun. 25, 2014 for DK Patent Application No. PA 2013 70665, 5 pages.
First Technical Examination dated Jun. 26, 2014 for DK Patent Application No. PA 2013 70664, 5 pages.
First Technical Examination and Search Report dated Jun. 27, 2014 for DK Patent Application No. PA 2013 70666, 5 pages.
Non-Final Office Action dated Jul. 29, 2014 for U.S. Appl. No. 13/917,448.
Final Office Action dated May 19, 2014 for U.S. Appl. No. 13/740,471.
Non-Final Office Action dated Mar. 27, 2014 for U.S. Appl. No. 13/848,605.
Extended European Search Report dated Mar. 7, 2014 for EP Patent Application No. 11184503.8.
Extended European Search Report dated May 6, 2014 for EP Patent Application No. 13175258.6.
Extended European Search Report dated Apr. 17, 2014 for EP Patent Application No. 13192316.1.
Extended European Search Report dated Apr. 22, 2014 for EP Patent Application No. 13192323.7.
Non-final Office Action dated Nov. 18, 2014 for U.S. Appl. No. 13/271,180.
Non-final Office Action dated Nov. 19, 2014 for U.S. Appl. No. 13/931,556.
Non-final Office Action dated Dec. 18, 2014 for U.S. Appl. No. 13/740,471.
Non-final Office Action dated Jan. 5, 2015 for U.S. Appl. No. 13/848,605.
Extended European Search Report dated Oct. 9, 2014 for related EP Patent Application No. 14181165.3.
"Novelty Search including a Preliminary Patentability Opinion Report", dated Jul. 28, 2011 (8 pages).
Non-final Office Action dated Jan. 15, 2015 for U.S. Appl. No. 14/199,511.
Non-final Office Action dated Feb. 5, 2015 for U.S. Appl. No. 14/198,396.
Non-final Office Action dated Feb. 24, 2015 for U.S. Appl. No. 14/202,486.
Notice of Allowance dated Mar. 5, 2015 for U.S. Appl. No. 13/917,448.
Notice of Allowance dated Apr. 24, 2015 for U.S. Appl. No. 13/931,556.
First Technical Examination and Search Report dated Mar. 9, 2015, for related Danish Patent Application No. PA 2014 70489.
Non-final Office Action dated May 7, 2015 for U.S. Appl. No. 13/271,180.
Notice of Allowance and Fee(s) Due dated May 22, 2015 for U.S. Appl. No. 13/848,605.
Non-final Office Action dated Jun. 10, 2015 for U.S. Appl. No. 14/199,263.
Notice of Allowance and Fee(s) Due dated Jun. 18, 2015, for U.S. Appl. No. 13/917,448.
Communication pursuant to Article 94(3) EPC dated Mar. 16, 2015, for related European Patent Application No. 11 184 503.8, 12 pages.
Communication pursuant to Article 94(3) EPC dated Mar. 19, 2015, for related European Patent Application No. 11 184 507.9, 12 pages.
Notice of Allowance and Fee(s) Due dated Nov. 18, 2015 for related U.S. Appl. No. 13/931,556.
Final Office Action dated Nov. 18, 2015 for related U.S. Appl. No. 14/199,263.
Non-final Office Action dated Dec. 2, 2015 for related U.S. Appl. No. 13/271,180.
Notice of Allowance and Fee(s) Due dated Dec. 18, 2015 for related U.S. Appl. No. 13/917,448.
Non-final Office Action dated Jul. 1, 2015 for U.S. Appl. No. 14/199,070.
Final Office Action dated Jul. 15, 2015 for related U.S. Appl. No. 13/740,471.
Notice of Allowance and Fees Due dated Aug. 3, 2015 for related U.S. Appl. No. 13/931,556.
Non-final Office Action dated Aug. 17, 2015 for related U.S. Appl. No. 14/198,396.
Non-final Office Action dated Aug. 25, 2015 for related U.S. Appl. No. 14/202,486.
Notice of Allowance and Fee(s) Due dated Sep. 2, 2015 for related U.S. Appl. No. 14/199,511.
Notice of Allowance and Fee(s) Due dated Sep. 3, 2015 for related U.S. Appl. No. 13/848,605.
Notification of Reasons for Rejection dated Nov. 24, 2015 for related Japanese Patent Application No. 2014-228343, 8 pages.

* cited by examiner

HEARING AID WITH AN ANTENNA

RELATED APPLICATION DATA

This application claims priority to, and the benefit of Danish Patent Application No. PA 2010 00931, filed on Oct. 12, 2010, Danish Patent Application No. PA 2011 00273 filed on Apr. 7, 2011, and Danish Patent Application No. PA 2011 70393, filed on Jul. 15, 2011, the entire disclosures of all of which are expressly incorporated by reference herein.

FIELD

The present disclosure relates to a hearing aid system that is adapted for wireless data communication. During operation, the hearing aids worn at opposite ears of the user may communicate wirelessly with each other.

BACKGROUND

Hearing aids are very small and delicate devices and comprise many electronic and metallic components contained in a housing small enough to fit in the ear canal of a human or behind the outer ear. The many electronic and metallic components in combination with the small size of the hearing aid housing impose high design constraints on radio frequency antennas to be used in hearing aids with wireless communication capabilities.

Conventionally, antennas in hearing aids have been used for receiving radio broadcasts or commands from a remote control. Typically, such antennas are designed to fit in the hearing aid housing without special concern with relation to the obtained directivity of the resulting radiation pattern. For example, behind-the-ear hearing aid housings typically accommodate antennas positioned with their longitudinal direction in parallel to the longitudinal direction of the banana shaped behind-the-ear hearing aid housing. In-the-ear hearing aids have typically been provided with patch antennas positioned on the face plate of the hearing aids as for example disclosed in WO 2005/081583; or wire antennas protruding outside the hearing aid housing in a direction perpendicular to the face plate as for example disclosed in US 2010/20994.

SUMMARY

In accordance with some embodiments, a hearing aid is provided, the hearing aid comprising a hearing aid assembly comprising a first antenna element configured for emission and reception of an electromagnetic field, a second antenna element configured for emission and reception of an electromagnetic field, the second antenna element comprising a first section and one or more parasitic antenna elements. The first antenna element, the first section and the one or more parasitic antenna elements may be configured so that the total electromagnetic field emitted from the hearing aid assembly is substantially the same irrespective of whether the housing is worn in its operational position on a right hand side or a left hand side of a user. The hearing aid assembly may be accommodated in a housing.

Preferably, the first antenna element, the first section and the one or more parasitic antenna elements are configured to emit a substantially TM polarized electromagnetic wave.

The first antenna element may be configured to communicate with a hearing aid accessory, thus being an accessory antenna. The second antenna element may be configured to communicate with a hearing aid, for example so that the second antenna element may be a proximity antenna configured to communicate with a hearing aid.

It is an advantage in some embodiments that a hearing aid with interchangeable right and left hearing aids is provided.

In an embodiment, the first antenna element may be arranged substantially on a first side of the hearing aid assembly and the parasitic antenna element may be arranged substantially on a second side of the hearing aid assembly, configured so that a current generated by an electromagnetic field flows in at least a first section of a supporting element from the first antenna element to the parasitic antenna element, the extent of the at least first section of the supporting element being between one sixteenth wavelength and a full wavelength of the emitted electromagnetic field.

In another aspect, a hearing aid is provided, the hearing aid comprising a hearing aid assembly comprising a first antenna configured for emission and reception of an electromagnetic field for communicating with a hearing aid accessory, and one or more parasitic antenna elements. The hearing aid assembly may comprise a housing for accommodation of the hearing aid assembly wherein the first antenna is arranged substantially on a first side of the hearing aid assembly and the parasitic antenna element is arranged substantially on a second side of the hearing aid assembly configured so that a current generated by the electromagnetic field flows in at least a first section of a supporting element from the first antenna to the parasitic antenna element, the at least first section of the supporting element being between one sixteenth wavelength and a full wavelength of the emitted electromagnetic field.

In a preferred embodiment, the second side is substantially parallel to the first side of the hearing aid assembly, such that the first section extends between two substantially parallel sides.

In one or more embodiments, the hearing aid assembly further comprises a microphone for reception of sound and conversion of the received sound into a corresponding first audio signal, a signal processor for processing the first audio signal into a second audio signal compensating a hearing loss of a user of the hearing aid, and a receiver that is connected to an output of the signal processor for converting the second audio signal into an output sound signal. Preferably, the hearing aid assembly has a first side and a second side interconnected via a supporting element. The hearing aid assembly may typically further comprise a transceiver configured for wireless data communication being interconnected with an antenna of the hearing aid antenna.

In another aspect, a method of communicating between a first hearing aid as herein described positioned at a first ear of a user and a second hearing aid as herein described positioned at a second ear of the user is provided, wherein the first and second hearing aids may be optionally positioned at a right ear or a left ear, respectively.

In other embodiments, a binaural hearing aid is provided, the binaural hearing aid comprising a first hearing aid as herein described and a second hearing aid as herein described, wherein the first hearing aid may optionally be positioned at a right ear of a user or a left ear of the user, and wherein the second hearing aid may be positioned at the other ear of the user.

In other embodiments, a hearing aid is provided, the hearing aid comprising a hearing aid assembly having a transceiver configured for wireless data communication being interconnected with at least a first antenna, a first antenna configured for emission and reception of an electromagnetic field for communicating with a hearing aid accessory, and one or more parasitic antenna elements, and a housing for accommodation of the hearing aid assembly wherein a first antenna excitation point and a parasitic antenna element excitation point are provided separated by a distance along an axis substantially parallel with the ear-to-ear axis of a user, the distance preferably being between one sixteenth wavelength and a full wavelength of the emitted electromagnetic field.

The supporting element may be configured so that upon excitation the current flows in at least the first section of the supporting element in a direction substantially parallel to an ear to ear axis of the user when the housing is worn in its operational position by the user. Preferably, the supporting element is excited by the first antenna.

Upon excitation, the parasitic antenna element and the supporting element may form a connecting antenna, and at least a part of the electromagnetic field emitted by the connecting antenna may propagate along the surface of the head of the user with its electrical field substantially orthogonal to the surface of the head of the user. When the electromagnetic field is diffracted around the head of a user, loses due to the interaction with the surface of the head are minimized.

The first section of the supporting element may be a first linear section, such as a rod-shaped section, that is positioned so that a longitudinal direction of the first section is parallel to the ear to ear axis when the housing is worn in its operational position by the user, or in other words perpendicular to, or substantially perpendicular to, the surface of the head proximate the operational position of the first section.

The configuration of the first section of the connecting antenna so that current flows in the first section in a direction in parallel to, or substantially in parallel to, an ear to ear axis of the user makes the antenna suitable for wireless communication between devices located in opposite ears or proximate opposite ears due to advantageous features of the emitted electromagnetic field as further explained below.

Preferably, the first antenna and/or the connecting antenna comprising the at least first section of the supporting element and the at least one parasitic antenna element are accommodated within the hearing aid housing, preferably so that the first antenna and the connecting antenna are positioned inside the hearing aid housing without protruding out of the housing.

During operation, the first section of the connecting antenna is configured to contribute to an electromagnetic field that travels around the head of the user thereby providing a wireless data communication that is robust and has low loss. Thus, during use, the connecting antenna may emit a substantially TM polarized electromagnetic field for diffraction around the head of a user, i.e. TM polarised with respect to the surface of the head of a user.

The first section of the connecting antenna is configured so as not to contribute substantially to an electromagnetic field in the direction of its current path, and therefore the connecting antenna does not, or substantially does not, emit an electromagnetic field in the direction of the ear to ear axis of the user during use when the hearing aid housing is positioned in its operational position at the ear of the user; rather, the connecting antenna is configured to emit a tailored electromagnetic field that propagates mainly in a direction parallel to the surface of the head of the user when the hearing aid housing is positioned in its operational position during use, whereby the electric field of the emitted electromagnetic field has a direction that is orthogonal to, or substantially orthogonal to, the surface of the head at least along the side of the head at which the connecting antenna is positioned during operation. In this way, propagation loss in the tissue of the head is reduced as compared to propagation loss of an electromagnetic field with an electric field component that is parallel to the surface of the head. Diffraction around the head makes the electromagnetic field emitted by the connecting antenna propagate from one ear and around the head to the opposite ear.

The current flowing in a linear antenna forms standing waves along the length of the antenna, and for proper operation, a linear antenna is typically operated at, or approximately at, a resonance frequency at which the length of the linear antenna equals a quarter wavelength or any multiple thereof of the emitted electromagnetic field. Thus, the connecting antenna may comprise the at least first section of the supporting element and may further comprise second and possibly further sections interconnected with the first section. These sections may form the parasitic antenna element. By interconnecting the at least first section of the supporting element with further sections, such as with a parasitic antenna element comprising the further sections, or with one or more parasitic elements, a combined length of the connecting antenna appropriate for emission of the desired wavelength of the electromagnetic field may be obtained. In one embodiment, the extent of the supporting element in a direction substantially in parallel to an ear to ear axis of the user when the housing is worn in its operational position by the user and the parasitic antenna element may be a quarter wavelength, or any multiple of a quarter wavelength.

In an embodiment wherein, the at least first section of the supporting element has a sufficient length and conducts a high current relative to the total current flowing in the connecting antenna at and proximate a maximum of the standing wave(s) formed by the current, the at least first section of the supporting element contributes significantly to the electromagnetic field emitted from the connecting antenna. Thereby the orientation of the second section and possible other sections of the parasitic antenna element are rendered less important or unimportant since these other sections do not contribute significantly to the electromagnetic field emitted from the connecting antenna during use. Preferably, the supporting element comprises a first section which is linear and is positioned with a longitudinal direction substantially parallel to an ear to ear axis of the user when the housing is worn in its operational position by the user, thus the orientation of the first section is parallel to an ear to ear axis and any second and further sections may have any orientation. In this way, the current in the connecting antenna has its maximum amplitude along the first linear section of the supporting element during emission of the electromagnetic field.

Thus, the orientation of current paths of sections of the parasitic antenna element may be determined in response to limitations imposed by the shape and small size of the hearing aid housing and desirable positioning and shape of other components in the housing. For example, second and possible further sections of the parasitic antenna element may be positioned so that current flows in the sections in directions in parallel to the surface of the head when the hearing aid housing is worn in its operational position at the ear of the user. The second and possibly further sections of the parasitic antenna element may comprise a patch antenna, a rod antenna, a monopole antenna, a meander line antenna, etc. or any combination thereof.

The hearing aid may further comprise one or more parasitic antenna elements in order to obtain a tailored directional pattern of the emitted electromagnetic field and possibly a specific polarization.

Thus, the connecting antenna formed by the combination of sections including the first section positioned so that current flows in the first section in a direction that is parallel to the ear to ear axis of the user during use, has a predetermined length for obtaining an effective emission of the tailored electromagnetic field, but the path of current flowing in the connecting antenna may exhibit a number of bends due to the different orientations of the sections provided in such a way that the connecting antenna fits inside the hearing aid housing while simultaneously being configured for emission of the tailored radiation pattern and the specific polarization at a specified radio frequency.

The required physical length of the connecting antenna may be decreased by interconnecting the connecting antenna with an electronic component, a so-called antenna shortening component, having an impedance that modifies the standing wave pattern of the antenna thereby changing its effective length. The required physical length of the connecting antenna may for example be shortened by connecting the connecting antenna in series with an inductor or in shunt with a capacitor.

Thus, the connecting antenna may have a single linear section of a relative short length, such as the first section such as about 1/16 wavelength, such as between 1/16 wavelength and 1/1 wavelength, such as between one sixteenth and three quarters wavelength, such as between one sixteenth and five eighths wavelength, such as between one sixteenth and a half wavelength, such as between one sixteenth and three eighths wavelength, such as between one sixteenth and one eighths wavelength. It is envisaged that for some embodiments, it may be advantageous to use a lower limit on the length being one eight wavelength. In a specifically preferred embodiment, the length of the first section is between one sixteenth wavelength and one eight wavelength. The optimum length is selected based on a number of criteria including any size restraints and strength of the electromagnetic field.

The hearing aid assembly is preferably positioned in the hearing aid housing in such a way that its longitudinal direction is parallel to an ear to ear axis of the user when the hearing aid housing is worn in its operational position at the ear of the user. Furthermore, the single linear section may be connected in series with an antenna shortening component, e.g. a serial inductor.

The hearing aid may further comprise an accessory antenna for communicating with a remote control or other accessories, such as a telephone, a television, a television box, a television streamer box, a spouse microphone, a hearing aid fitting system, etc. Preferably, the accessory antenna communicates at a frequency of 2.4 GHz. The first antenna may comprise the accessory antenna.

The accessory antenna is typically positioned to communicate with equipment positioned at a distance from the user, and is thus typically configured on or inside the housing so as to emit electromagnetic radiation to and receive electromagnetic radiation from the accessories.

Even though the first antenna and the connecting antenna, comprising the at least first section of the supporting element and the one or more parasitic antenna elements, are separate structural elements, they interact during operation of the hearing aid. In a preferred embodiment, the supporting element forms a ground plane for the first antenna and the supporting element may thus be grounded. When the supporting element provides a ground plane for the first antenna, the first antenna may induce a current in the supporting element upon excitation of the first antenna.

The first antenna is preferably a point fed antenna which may have an excitation point at the supporting element. The parasitic antenna element preferably has a first end at the supporting element, the first end being the excitation point for the parasitic antenna element. Thus, both the first antenna and the parasitic antenna element have an excitation point at the supporting element.

The excitation points provided at the supporting element may be interpreted broadly, and the excitation points may be provided in functional contact with the supporting element, preferably in functional contact with the at least first section of the supporting element, such as on a top, a bottom or a side of the supporting element, the excitation points may be provided in the supporting element, such as inside a structure provided on the supporting element, such as in-between layers of the supporting element, etc.

Upon excitation of the first antenna, a current may be induced in the supporting element from the excitation point for the first antenna to the excitation point of the parasitic antenna element.

In a preferred embodiment, the first antenna excitation point and the parasitic antenna element excitation point are separated by a distance along an axis substantially parallel to the ear-to-ear axis of a user, the distance preferably being between one sixteenth wavelength and a full wavelength. The induced current will then flow in at least a section of the supporting element from the first antenna excitation point to the parasitic antenna element excitation point in the direction parallel to the ear-to-ear axis of a user, and the current will excite the parasitic antenna element.

Preferably, the first antenna excitation point and the parasitic antenna element excitation point are provided at the supporting element so that upon excitation of the first antenna current flows in the at least first section of the supporting element in a direction which is substantially orthogonal to at least one of the first and second longitudinal sides of the housing. Thus, preferably the elements are structured so that the first antenna excitation point is provided at one end of the first section and the parasitic antenna element excitation point is provided at another end of the first section.

It is envisaged that the first antenna excitation point and the parasitic antenna element excitation point also may be provided separated by a distance along an axis being off axis with respect to the ear-to-ear axis or at an axis being a non-parallel to the ear-to-ear axis, or may even be provided on an axis orthogonal to the ear-to-ear axis.

In a preferred embodiment, the supporting element is a printed circuit board connecting the first antenna and the parasitic antenna element(s). In this case both the first antenna excitation point and the parasitic antenna element excitation point are provided at the printed circuit board.

The length of the at least first section of the supporting element may be defined as the length of the current path from the first antenna excitation point to the parasitic antenna element excitation point.

Preferably, the total electromagnetic field emitted from the first antenna and the connecting antenna is only limitedly influenced by the presence of a user's head when the housing is of the hearing aid is worn in its operational position by a user. In this way, the hearing aid may optionally be used on a right hand side or a left hand side of a user with limited influence on the emitted electromagnetic field.

The total electromagnetic field emitted from the connecting antenna and the first antenna may thus be substantially the same irrespective of whether the housing is worn in its operational position on a right hand side or a left hand side of a user. The hearing aid comprising the antenna elements may be any hearing aid, such as an in-the-ear hearing aid, or preferably such as a behind-the-ear (BTE) hearing aid, etc.

The specific positioning of the first antenna and the connecting antenna may be determined by the shape of the hearing aid.

For example behind-the-ear hearing aid housings typically accommodate first antennas positioned with their longitudinal direction in parallel to the longitudinal direction of the banana shaped behind-the-ear hearing aid housing on one side of the hearing aid, while in-the-ear hearing aids typically have been provided with patch antennas positioned on the face plate of the hearing aids.

In some embodiments, the housing is a behind-the-ear housing configured to be positioned behind the ear of the user during use and the first antenna is provided on a first side of the hearing aid housing, and the parasitic antenna element(s) are provided on a second side of the hearing aid housing. The first antenna and the parasitic antenna element may be connected via a supporting element, such as a printed circuit board, such as a supporting element comprising an antenna, such as any conducting element.

The parasitic antenna element may have a first end and a second end, and the parasitic antenna element may be excited at the first end.

The connecting antenna and the first antenna may be configured for operation in the ISM frequency band. Preferably, the antennas are configured for operation at a frequency of at least 1 GHz, such as at a frequency between 1.5 GHz and 3 GHz such as at a frequency of 2.4 GHz.

In accordance with some embodiments, a hearing aid includes a housing, and a hearing aid assembly accommodated in a housing, the hearing aid assembly having a first antenna element configured for emission of an electromagnetic field, and a second antenna element comprising a first section and a parasitic antenna element, wherein the first antenna element, the first section, and the parasitic antenna element are configured so that a total electromagnetic field emitted from the hearing aid assembly is substantially the same irrespective of whether the housing is worn in its operational position on a right hand side or a left hand side of a user. In some embodiments, the first antenna element is also configured for reception of an electromagnetic field.

Other and further aspects and features will be evident from reading the following detailed description of the embodiments.

DESCRIPTION OF THE DRAWING FIGURES

Figure 1A:
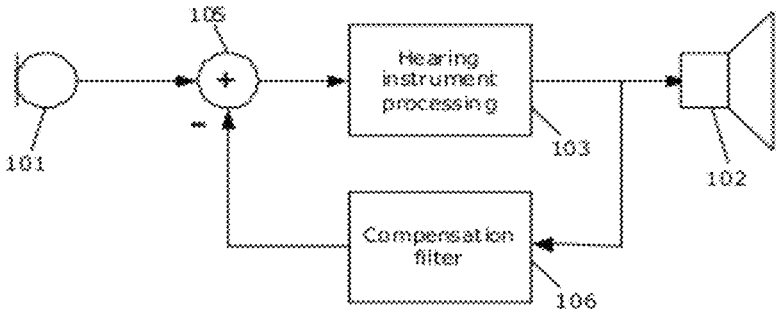
Figure 2A:
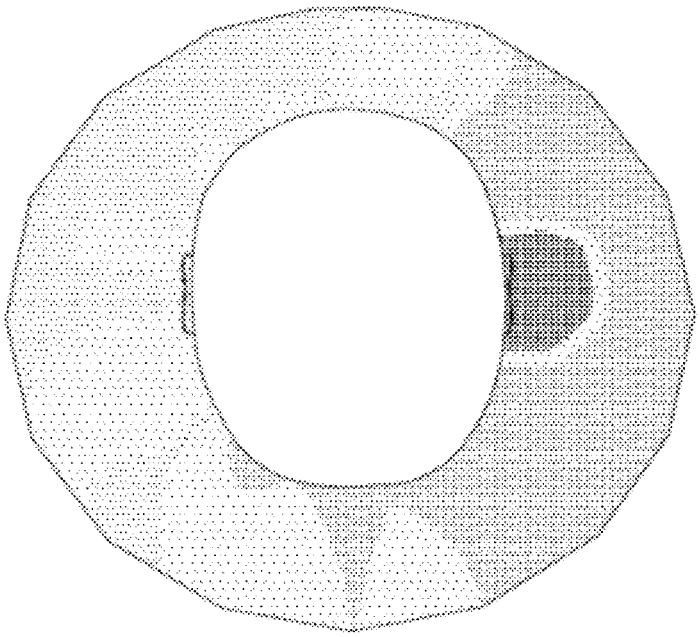
Fig. 2a. (prior art)
Figure 2B:
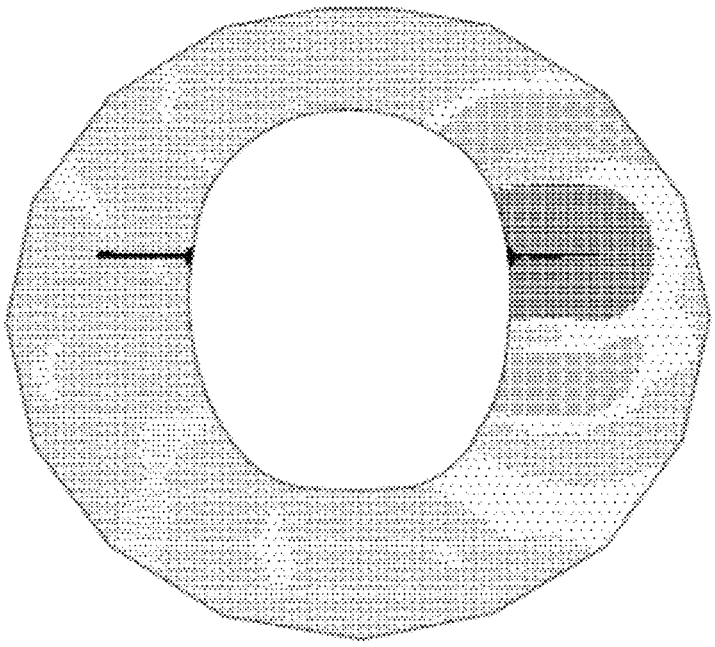
Figure 3:
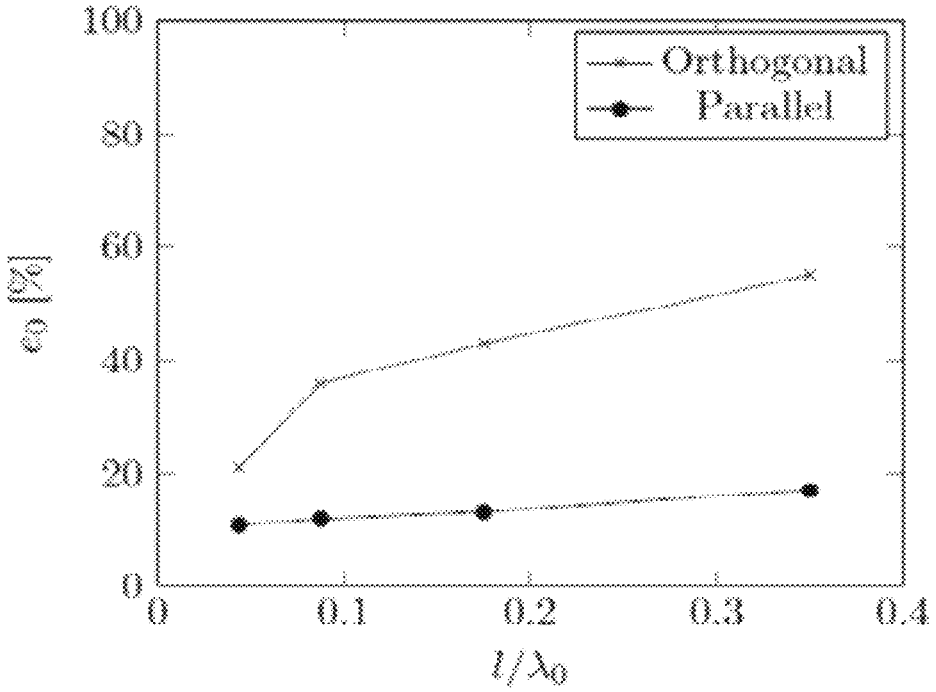
Figure 4:
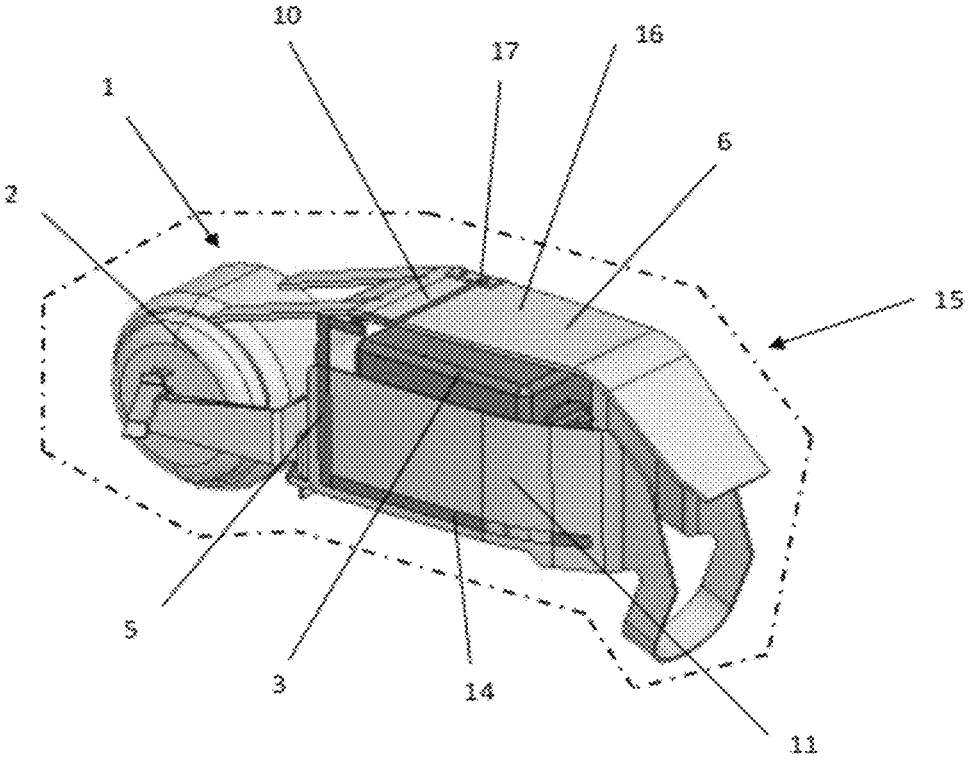
Figure 5A:
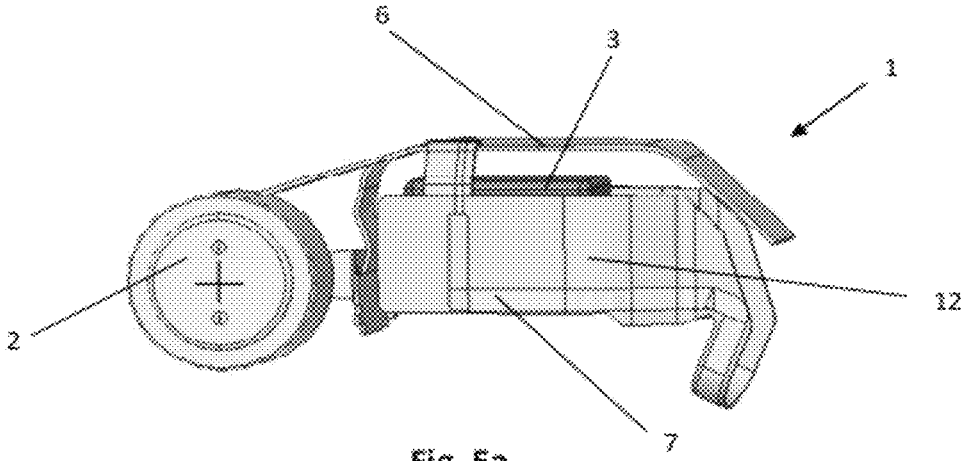
Figure 5B:
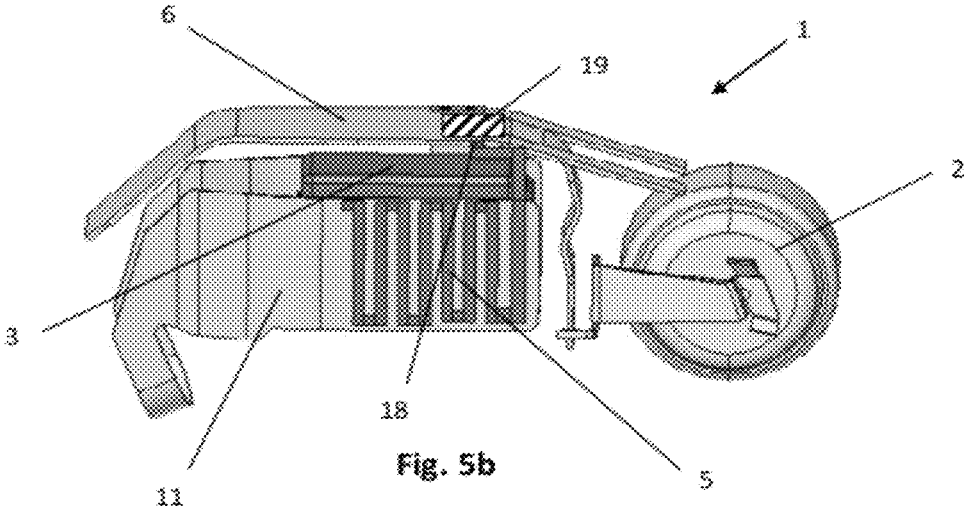

The above and other features and advantages will become more apparent to those of ordinary skill in the art by describing in detail exemplary embodiments thereof with reference to the attached drawings in which:

FIG. 1 is a phantom head model of a user together with an ordinary rectangular three dimensional coordinate system with an x, y and z axis for defining the geometrical anatomy of the head of the user, FIG. 1*a* shows a block-diagram of a typical hearing aid, FIG. 2*a* is a plot of the strength of the electric field (E) around the head for a parallel antenna configuration seen from above the head (prior art), FIG. 2*b* is a plot of the strength of the electric field (E) around the head for an orthogonal antenna configuration seen from above the head, FIG. 3 is the total efficiency of a parallel as well as an orthogonal antenna configuration as a function of antenna length, FIG. 4 is a view from the side of various parts of an exemplary BTE hearing aid with an orthogonal antenna, FIG. 5*a* is a view from the left hand side of various parts of another exemplary BTE hearing aid with an orthogonal antenna, and FIG. 5*b* is a view from the right hand side of the parts shown in FIG. 5*b*.

Figure 6:
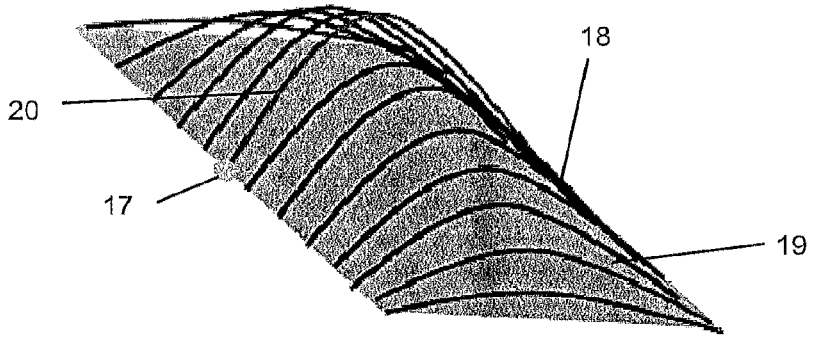
Figure 7A:
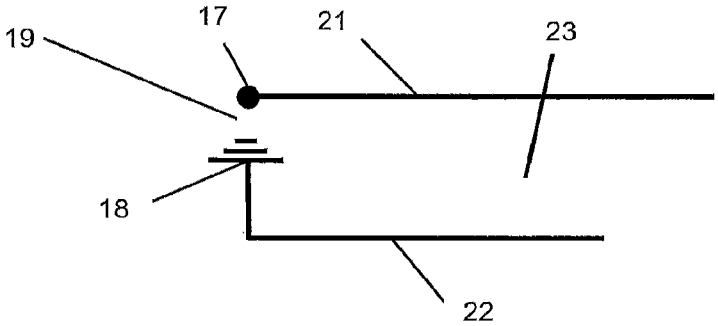
Figure 7B:
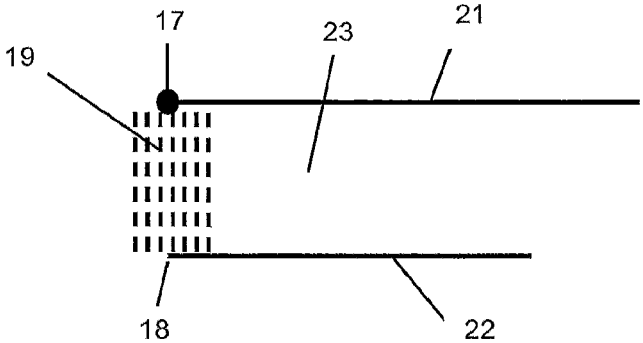
Figure 7C:
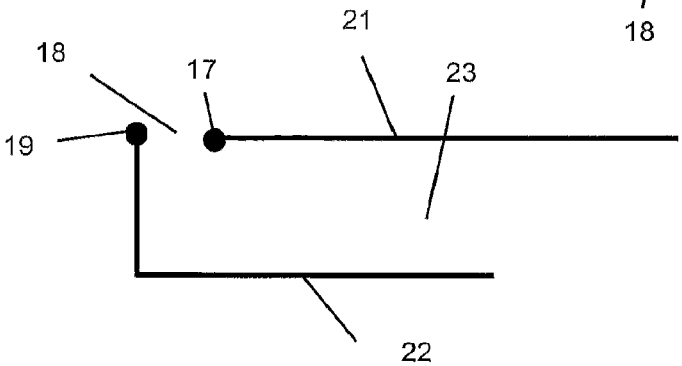

FIG. 6 is a plot of the current distribution across the at least first section of the supporting element in accordance with some embodiments, FIGS. 7*a-c* show schematically exemplary implementations of the first antenna and the at least one parasitic element.

FIGS. 8*a-d* are plots showing the electromagnetic field distribution around the head of a user with the hearing aid being positioned on a right hand side and a left hand side of a user, respectively.

DETAIL DESCRIPTION

Various embodiments are described hereinafter with reference to the figures. It should be noted that the figures are not drawn to scale and that elements of similar structures or functions are represented by like reference numerals throughout the figures. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated. Also, reference throughout this specification to "some embodiments" or "other embodiments" means that a particular feature, structure, material, or characteristic described in connection with the embodiments is included in at least one embodiment. Thus, the appearances of the phrase "in some embodiments" or "in other embodiments" in various places throughout this specification are not necessarily referring to the same embodiment or embodiments.

In the following, a parallel antenna or a parallel section of an antenna designates an antenna or a section of an antenna, respectively, in a device that is worn at the ear of a user during use and that conducts current mainly in directions parallel to the surface of the head at the ear of the user, or in other words perpendicular to the ear to ear axis of the user, and an orthogonal antenna or an orthogonal section of an antenna designates an antenna or a section of an antenna, respectively, in a device that is worn at the ear of a user during use and that, at least in a section of the antenna, conducts current in a direction that is orthogonal to the surface of the head at the ear of the user, or in other words parallel to the ear to ear axis of the user.

The radiation pattern of an antenna is typically illustrated by polar plots of radiated power in horizontal and vertical planes in the far field of the antenna. The plotted variable may be the field strength, the power per unit solid angle, or directive gain. The peak radiation occurs in the direction of maximum gain.

When designing antennas for wireless communication proximate the human body, the human head can be approximated by a rounded enclosure with sensory organs, such as the nose, ears, mouth and eyes attached thereto. Such a rounded enclosure 9 is illustrated in FIG. 1. In FIG. 1, the phantom head model is shown together with an ordinary rectangular three dimensional coordinate system with an x, y and z axis for defining orientations with relation to the head.

Every point of the surface of the head has a normal and a tangential vector. The normal vector is orthogonal to the surface of the head while the tangential vector is parallel to the surface of the head. An element extending along the surface of the head is said to be parallel to the surface of the head while an object extending from a point on the surface of the head and radially outward from the head into the surrounding space is said to be orthogonal to the head.

As an example, the point with reference numeral 8 in FIG. 1 furthest to the left on the surface of the head in FIG. 1 has tangential vectors parallel to the yz-plane of the coordinate system, and a normal vector parallel to the x-axis. Thus the y-axis and z-axis are parallel to the surface of the head at the point 9 and the x-axis is orthogonal to the surface of the head at the point 9.

The user modelled with the phantom head of FIG. 1 is standing erect on the ground (not shown in the figure), and the ground plane is parallel to the xy-plane. The torso axis from top to toe of the user is thus parallel to the z-axis, whereas the nose of the user is pointing out of the paper along the y-axis.

The axis going through the right ear canal and the left ear canal is parallel to the x-axis in the figure. This ear to ear axis (ear axis) is thus orthogonal to the surface of the head at the points where it leaves the surface of the head. The ear to ear axis as well as the surface of the head will in the following be used as reference when describing specific configurations of the elements in one or more embodiments.

Since the auricle of the ear is primarily located in the plane parallel to the surface of the head on most test persons, it is often described that the ear to ear axis also functions as the normal to the ear. Even though there will be variations from person to person as to how the plane of the auricle is oriented.

The in the ear canal type of hearing aid will have an elongated housing shaped to fit in the ear canal. The longitudinal axis of this type of hearing aid is then parallel to the ear axis. The behind the ear type of hearing aid will typically also have an elongated housing most often shaped as a banana to rest on top of the auricle of the ear. The housing of this type of hearing aid will thus have a longitudinal axis parallel to the surface of the head of the user.

With reference to FIG. 1, the length of a behind the ear apparatus will primarily be measured along the y-axis whereas the width will be measured along the x-axis and the height be measured along the z-axis.

A block-diagram of a typical (prior-art) hearing instrument is shown in FIG. 1*a*. The hearing aid comprises a microphone 101 for receiving incoming sound and converting it into an audio signal. A receiver 102 converts output from the hearing instrument processor 103 into output sound, e.g. modified to compensate for a users hearing impairment. Thus, the hearing instrument processor 103 may comprise elements such as amplifiers, compressors and noise reduction systems etc. For communication with the surroundings a hearing aid is typically provided with a transceiver for wireless data communication interconnected with an antenna.

For proper operation, an e.g. rod-shaped antenna must have a length approximately equal to a quarter of the wavelength of the emitted electromagnetic field at the desired radio frequency. Conventionally, orthogonal rod-shaped antennas have been too long to be accommodated inside a hearing aid housing with no parts protruding from the housing.

FIGS. 2*a* and 2*b* illustrate the power of an electromagnetic field radiated around the head of a human, when the electromagnetic field is emitted by an antenna positioned at one of the ears of the human. The electromagnetic field is viewed from above the head of the human. The power values are illustrated in grey-levels, high power is black and low power is white.

In FIG. 2*a*, the electromagnetic field is emitted by a parallel rod antenna. The radiating antenna is shown to the right in FIG. 2*a* in black as a black rod. FIG. 2*a* shows how the parallel antennas of the prior art performs. The plot shows the strength of the electric field around the head. The field strength in the plot is indicated by the tone of the grey-level: The stronger the field the darker the grey level. For example, the plot around the radiating antenna is almost black. Thus, the field strength around the antenna is high. The grey-levels get paler and paler with increased distance to the antenna. The field strength at the receiving antenna at the opposite side of the head is very low and the plot around the receiving antenna is almost white. Thus, in order to obtain reliable wireless communication with parallel antennas in devices worn at the two ears of a human, the devices have to comprise a powerful amplifier for amplification of the received signal; and/or a powerful amplifier for transmission of a high power electromagnetic signal. In a hearing aid, this is not desirable, since batteries supplying power for hearing aid circuitry are small and have limited power capacity.

In FIG. 2*b*, the electromagnetic field is emitted by an orthogonal rod antenna. Again, the radiating antenna is shown to the right in FIG. 2*b* in the form of a black rod.

The strength of the electric field is plotted around the head in the same way as in FIG. 2*a*. It should be noted that the strength of the electromagnetic field at the opposite side of the head at the receiving antenna is larger than in FIG. 2*a*, and therefore reliable wireless communication between orthogonal antennas in devices at worn the two ears of a human can be established without the requirement of powerful amplifiers.

The improvement is believed to be caused by the fact that a parallel rod antenna emits an electromagnetic field primarily in a direction perpendicular to the surface of the head at the position of the antenna when the hearing aid housing is worn in its operational position by the user, and the electrical field of the electromagnetic field is parallel to the surface of the head giving rise to resistive transmission loss in the tissue of the head.

Contrary to this, an orthogonal rod antenna emits an electromagnetic field primarily in a direction parallel to the surface of the head when the housing is worn in its operational position by the user facilitating transmission of the electromagnetic field around the head, and the electrical field of the electromagnetic field is perpendicular to the surface of the head whereby transmission loss in the tissue of the head is reduced.

The orthogonal and parallel antennas in FIGS. 2*a* and 2*b* are provided to illustrate the principle of the electromagnetic field propagation around the head and the antennas shown are not to scale.

The limited space available in a hearing aid housing makes it difficult to accommodate an orthogonal rod-shaped antenna in a hearing aid housing; however it has been shown that the rod-shaped antenna may have one or more bends without deteriorating its performance significantly, provided that the part of the rod-shaped antenna that emits the part of the emitted electromagnetic field received at the opposite ear maintains its orthogonal orientation.

During operation, the rod-shaped antenna conducts a current of a standing wave. The free end of the rod-shaped antenna constitutes a node of the standing wave in which the current is zero. Thus, the part of the rod-shaped antenna proximate its free end does not contribute with a significant part of the magnetic field of the emitted electromagnetic signal. At the root of the rod-shaped antenna being connected to the transceiver circuitry of the hearing aid and supplied with current, the current has a maximum amplitude, and therefore the part of the rod-shaped antenna proximate the root of the antenna, or the excitation point of the antenna, contribute with a significant part of the magnetic field of the emitted electromagnetic field. Thus, preferably, a part of the antenna proximate the root of the antenna, or the excitation point of the antenna, constitutes a first linear section of the antenna having a longitudinal direction that is orthogonal to the surface of the head of the user, when positioned in its desired operational position at the ear of the user. The orientation of the remaining part of the antenna is not critical in order to obtain the desired power of the electromagnetic field at the opposite ear of the user, but further section(s) is/are required in order for the antenna to have the required length for proper operation at the desired radio frequency, e.g. equal to, or approximately equal to, a quarter wavelength of the electromagnetic field or any multiple thereof.

In FIG. 3, total efficiencies of a parallel monopole rod antenna and an orthogonal monopole rod antenna with relation to path loss around the head of a human are compared as a function of physical antenna length. The resonance frequency of the antennas is kept the same by using a serial inductance. It should be noted that even the shortest orthogonal antenna in the figure, the antenna being 1/16 wavelength, is seen to be more effective in establishing an electromagnetic field at the opposite side of the head than the longest parallel antenna.

FIG. 4 shows an assembly of various parts 1 of a BTE hearing aid with a connecting antenna 10, 5 having a first linear section 10 that is positioned with a longitudinal direction substantially in parallel to an ear to ear axis of the user when the housing is worn in its desired operational position by the user. The first linear section 10 is located at the top side 16 of the assembly 1, and it extends along the entire width of the top side 16 of the assembly. The first linear section 10 is fed with current from the printed circuit board 6. The connecting antenna further has a second linear section 5 with a longitudinal direction substantially perpendicular to the longitudinal direction of the first linear section 10 and substantially parallel to the side 11 of the BTE hearing aid assembly 1. The antenna ends in a third linear section 14 that has a longitudinal direction that is substantially perpendicular to both the first section 10 and the second linear section 5 and substantially parallel to the side 11 of the assembly 1 and thus to the BTE hearing aid housing. The connecting antenna is configured to be excited from the excitation point 16. The BTE hearing aid housing 15 accommodating the hearing aid assembly 1 in its entirety is illustrated in FIG. 4 with a dashed line.

The first, second, and third linear sections 10, 5, 14 of the connecting antenna are electrically interconnected and the interconnected first, second and third linear sections form the antenna of the required length. The connection between the first and second linear sections 10, 5 is typically located where the top 16 of the assembly 1 and the side 11 of the assembly 1 intersect. When current flows through the excitation point 17 into the first linear section 10, it will continue into the second linear section 5 while experiencing a bend where the two sections are connected. The second linear section 5 and the third linear section 14 extend along the right or left side 11, 12 of the hearing aid assembly 1, and thus also extend along the right or left side of the inside of the hearing aid housing 15 and the antenna is terminated with a free end with no connection to other parts. A current in the antenna will thus have a zero or node at the free end, and the antenna current has its largest magnitude at the excitation point.

The illustrated assembly 1 are accommodated in a hearing aid housing 15 (dashed line). In the illustrated BTE hearing aid, the battery 2 is housed in the rear of the hearing aid housing, and the transceiver 3 is housed centrally in the hearing aid assembly 1. The battery 2 provides power to the hearing aid circuitry and components including the transceiver 3 for generating sound for emission towards the tympanic membrane of the user and for wireless data communication and being interconnected with at least a first antenna, such as a first antenna element. The transceiver 3 may be also be provided as two separate transceivers for generating sound and for wireless data communication, respectively.

The signal processor (not shown) of the hearing aid is located on the printed circuit board 6.

When the hearing aid is worn in its operational position at the ear of the user, the antenna comprising the first, second and third linear sections 10, 5, 14 provide radiation of an electromagnetic field in parallel to the surface of the head of the user and with an electrical field that is orthogonal to the surface of the head.

FIGS. 5*a* and 5*b* show opposite sides of a hearing aid assembly of various parts 1 of another BTE hearing aid with another exemplary orthogonal antenna.

The illustrated hearing aid assembly of the BTE hearing aid include a battery 2, a transceiver 3, a printed circuit board 6, internal wall parts, or first and second sides of the hearing aid assembly 11, 12 and a first antenna, such as an accessory antenna 7. The signal processor (not shown) is located on the printed circuit board 6.

In FIG. 5*a*, the first antenna 7 is located at the first side 12 of the hearing aid housing. However, the first antenna 7 may be located at a second side of the housing, at the top side of the housing, at the front side of the housing, at the back side of the housing or at the bottom side of the housing. The allowable length of the first antenna 7 is constrained by the length of the side of the housing at which it is located. The longer the side, the longer the part can be. In general, the length of the first antenna is dictated by the operating frequency, the group velocity of the current flowing in the antenna and the number of nulls that is desired. Normally, the velocity is approximated by the velocity of light in free space. An antenna with a length of a quarter of a wave will have a current with its maximum magnitude at the excitation point and a null at the end of the antenna.

The first antenna 7 may act as a passive element where it shields the hearing aid electronics from interference or act as part of an antenna configured for a specific radiation pattern. In the embodiment shown in FIGS. 5*a-b*, the first antenna 7 is an active element being excited from an excitation point 17 on the printed circuit board and radiates an electromagnetic field into the surrounding space. Dependent on which side of the housing the first antenna is located on, the radiated electric field will have slightly different characteristics and radiation patterns with respect to the head 9 of the user.

FIG. 5*b* is a view from the second, or in this case the left hand side, of the BTE hearing aid assembly 1 shown in FIG. 5*a* and shows a parasitic antenna element 5. The parasitic antenna element 5 is comprised of metal or similar material in order to conduct a current of electric charges. The parasitic element may be located on any side of the hearing aid housing.

The supporting element 6 is in this case the printed circuit board 6, which forms a ground plane for the first antenna. In this way, upon excitation of the first antenna, a current generated by the electromagnetic field flows in at least a first section 19 of the supporting element 6 from the first antenna to the parasitic antenna element and excites the parasitic element. The at least first section of the supporting element may comprise the entire supporting element or any part thereof.

Preferably, the excitation point 18 for the parasitic antenna element 5 is separated by a distance from the excitation point 17 of the first antenna 7 along an axis substantially parallel to the ear to ear axis. Preferably, the excitation point 18 for the parasitic antenna element 5 and the excitation point 17 of the first antenna 7 are positioned on opposite sides of the hearing aid assembly 1.

However, it is envisaged that at least a part of the first antenna 7 and/or the parasitic antenna element 5 may be provided on any side of the hearing aid, as long as the excitation points 17, 18 separated by a distance along an axis substantially parallel to the ear to ear axis. Furthermore, at least a part of the first antenna 7 and/or the parasitic antenna element may extend along the supporting element.

Preferably, the at least first section 19 of the supporting element is between one sixteenth wavelength and a full wavelength of the emitted electromagnetic field, the length being measured along the path of maximum current between the excitation points 17, 18.

In FIG. 5*b*, the parasitic antenna element 5 is located on the second side 11 of the hearing aid assembly 1. The parasitic antenna element 5 may be a separate element with no connections to the other elements in the hearing aid, or as seen in FIG. 5*b*, it can be operatively connected to the first antenna 7, via supporting element 6, such as e.g. via the printed circuit board 6.

In FIG. 5*b*, the first section 19 of the supporting element, i.e. the conducting part of the supporting element 6 interconnecting the first antenna 7 with the parasitic antenna element 5 constitutes a part of the connecting antenna comprising the first section of the supporting element, i.e. the orthogonal antenna, and the parasitic antenna element 5.

In the embodiment of FIG. 5*b*, the three conducting parts, i.e. the first antenna 7, the parasitic antenna element 5, and the printed circuit board 6, are structured relative to each other such that when the hearing aid is located on the head 9 of a user and a current flows in the conducting elements, the current in the conducting element 6 will flow in a direction parallel to the ear to ear axis for emission of an electromagnetic field as explained above. The conducting part will thus constitute the first section and be orthogonal because the hearing aid is worn at the ear during use and at this position of the head, a conducting element being parallel to the ear to ear axis will be orthogonal to the surface of the head.

The current in the part of the circuit board 6 interconnecting the first antenna 7 and the parasitic element 5 must flow in a direction substantially parallel to the ear to ear axis so that the emitted electromagnetic field propagates substantially in parallel to the surface of the head. The electromagnetic field thus propagates along the surface of the head until it reaches the ear on the other side of the head.

Although the radiation pattern of the antenna configuration may have side lopes, most of the radiated power will propagate in parallel to the surface of the head.

The configuration of the three parts of the orthogonal antenna illustrated in FIG. 5, furthermore has the property that the overall emitted electromagnetic field is polarized in a transverse magnetic mode so that the electrical field is orthogonal to, or substantially orthogonal to, the surface of the head so that the electromagnetic field propagates without, or with low, resistive transmission loss in the tissue of the head.

Preferably, in order to obtain effective radiation, the length of the current path of the first section of the antenna, in the illustrated example located on the printed circuit board 6, that is parallel to the ear to ear axis (orthogonal to the surface of the head proximate the operational position of the hearing aid at the ear of the user) equals the length of the side of the hearing aid assembly at which it is located. This configuration can for example be achieved by placing said conducting part at the top side of the hearing aid assembly and the first antenna and parasitic antenna element 5 on the right and left side respectively. When the illustrated hearing aid is located in its operational position behind the ear, the first section of the supporting element will constitute the first section and be orthogonal and extend along the entire top side of the housing. Furthermore, to achieve a maximum current in the at least first section of the supporting element, it is preferred that the first section has a length between one sixteenth wavelength and a full wavelength of the emitted electromagnetic field.

An exemplary current distribution in the first section 19 of the supporting element is shown in FIG. 6. The connecting plane is excited at the excitation point for the first antenna 17 and the maximum current 20 is along the shortest path to the excitation point for the parasitic antenna element 18.

In another exemplary BTE hearing aid with an orthogonal antenna, the orthogonal antenna has a single linear section that is relatively short. The single linear section is positioned in the hearing aid housing so that its longitudinal direction is orthogonal to, or substantially orthogonal to, the surface of the head of the user when the hearing aid is positioned in its operational position at the ear of the user. Furthermore, the single linear section is connected in series with an antenna shortening component, e.g. a serial inductor.

However, also other embodiments of the antenna and the antenna configurations may be contemplated.

A number of possible antenna designs are shown schematically in FIGS. 7*a-c*. The hearing aid assembly 1 is seen from the top, and the antennas and the position of the antenna excitation points are schematically illustrated.

FIG. 7*a* shows a first antenna 21 having an excitation point 17. The supporting element 23 forms a ground plane for the first antenna 21 and the excitation point 18 for the parasitic antenna element 22 is positioned a distance from the first antenna excitation point 17 along an axis substantially parallel to the ear to ear axis. The first section 19 of the supporting element 6 does in this example not extend over the width of the hearing aid.

FIG. 7*b* shows an example of a preferred embodiment where the distance between the first antenna excitation point 17 and the parasitic antenna element excitation point 18, and thus the extent of the first section, corresponds to the width of the hearing aid assembly.

In FIG. 7*c*, an alternative embodiment is shown, wherein the excitation points 17, 18 are positioned separated by distance along an axis orthogonal to the ear to ear axis. In this case, the parasitic antenna element 22 is preferably connected to an antenna shortening component to ensure that a maximum current is provided in the part of the antenna orthogonal to the head.

FIG. 8 shows directivity plots for a hearing aid according to some embodiments, and it is seen that the difference between positioning the hearing aid on a right hand side of a user and a left hand side of the user are minimal. The difference is caused by the mirroring of the antenna placement, so that when a device is positioned at for example the left side of a user, the first antenna is placed further away from the head than when the same device is positioned on the right hand side. It is thus an advantage of the hearing aid according to some embodiments that the hearing aid may be used optionally on a right hand side and a left hand side of a user with only a minimal impact on the wireless connection both to external accessories as to the other of two hearing aids in a binaural hearing aid.

Figure 8A:
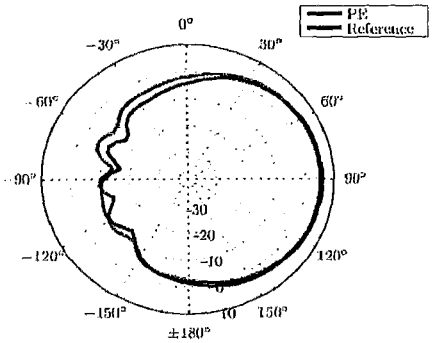
Figure 8B:
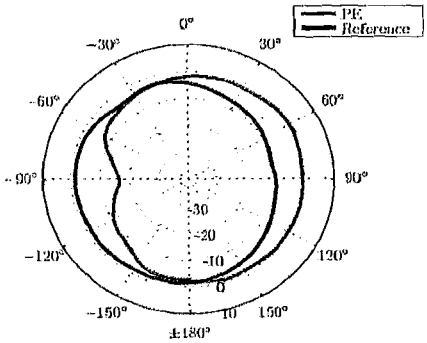

FIG. 8*a* shows the θ-cut for $\phi=0°$ total directivity, and FIG. 8*b* shows the θ-cut for $\phi=90°$ total directivity both at 2441 MHz for a hearing aid according to some embodiments, positioned on a left hand side position of a user.

Figure 8C:
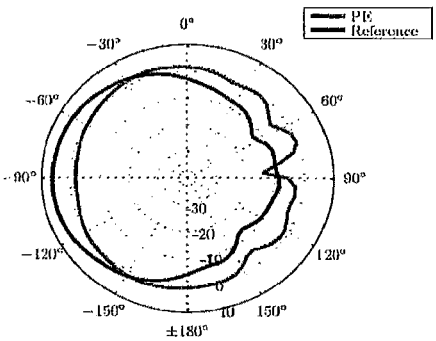
Figure 8D:
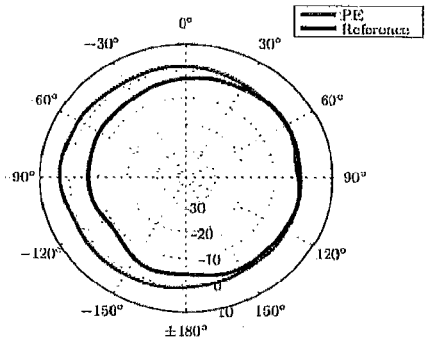

FIG. 8*c* shows the θ-cut for ϕ=0° total directivity, and FIG. 8*d* shows the θ-cut for ϕ=90° total directivity both at 2441 MHz for a hearing aid according to some embodiments, positioned on a right hand side position of a user.

In general, various sections of the antenna can be formed with many different geometries, they can be wires or patches, bend or straight, long or short as long as they obey the above relative configuration with respect to each other such that at least one conducting part will carry a current being primarily parallel to the ear axis (orthogonal to the surface of the head 9 of the user at a point 8 in proximity to the ear) such that the field will be radiated in the desired direction and with the desired polarization such that no attenuation is experienced by the surface wave travelling around the head.

The specific wavelength, and thus the frequency of the emitted electromagnetic field, is of importance when considering communication involving an obstacle. In some embodiments, the obstacle is a head with a hearing aid comprising an antenna located closed to the surface of the head. If the wavelength is too long such as a frequency of 1 GHz and down to lower frequencies greater parts of the head will be located in the near field region. This results in a different diffraction making it more difficult for the electromagnetic field to travel around the head. If on the opposite side the wavelength is too short the head will appear as being too large an obstacle which also makes it difficult for electromagnetic waves to travel around the head. An optimum between long and short wavelengths is therefore preferred. In general the ear to ear communication is to be done in the band for industry, science and medical with a desired frequency centred around 2.4 GHz.

It should be noted that as used in this specification, the term "substantially" refers to a value variation that is within plus or minus 10%. For example, the term "substantially orthogonal" and similar terms refer to an angle that is 90±9 degrees. Similarly, the term "substantially parallel" and similar terms refer to angle that is 0 (or 180 degrees)±18 degrees.

Although particular embodiments have been shown and described, it will be understood that they are not intended to limit the claimed invention, and it will be obvious to those skilled in the art that various changes and modifications may be made without departing from the spirit and scope of the present inventions. The specification and drawings are, accordingly, to be regarded in an illustrative rather than restrictive sense. The claimed invention are intended to cover alternatives, modifications, and equivalents.

The invention claimed is:

1. A hearing aid comprising:

a housing; and a hearing aid assembly accommodated in the housing, the hearing aid assembly having a first antenna element configured for emission of an electromagnetic field, and a second antenna element comprising a first section and a parasitic antenna element;

wherein the first antenna element and the second antenna element are electrically separated from each other, and wherein at least a part of the first antenna element and at last a part of the second antenna element lie in different respective planes that are opposite from each other; and wherein the first antenna element, the first section, and the parasitic antenna element are configured to emit an electromagnetic wave.

2. The hearing aid according to claim 1, wherein the first antenna element is arranged substantially on a first side of the hearing aid assembly, and the parasitic antenna element is arranged substantially on a second side of the hearing aid assembly, and wherein a current generated by the electromagnetic field flows from the first section to the parasitic antenna element.

3. The hearing aid according to claim 1, wherein the first section is positioned with a longitudinal direction substantially in parallel with an ear-to-ear axis of the user when the housing is worn in its operational position by the user.

4. The hearing aid according to claim 1, wherein the first section is a part of a supporting element, the supporting element forming a ground plane for the first antenna element.

5. The hearing aid according to claim 1, wherein the first section is a part of a supporting element, the supporting element being a printed circuit board supporting the first antenna element and the parasitic antenna element.

6. The hearing aid according to claim 1, wherein a first antenna element excitation point and a parasitic antenna element excitation point are separated by a distance along an axis substantially parallel with an ear-to-ear axis of the user, the distance being between one sixteenth wavelength and a full wavelength.

7. The hearing aid according to claim 6, wherein the first section is a part of a supporting element, and wherein the first antenna element excitation point and the parasitic antenna element excitation point are located at the supporting element.

8. The hearing aid according to claim 1, wherein the first section has a first part corresponding with the first antenna element excitation point, and a second part corresponding with the parasitic antenna element excitation point, and wherein upon excitation of the first antenna element, a current is induced in the first section and in the parasitic antenna element, the current having its maximum amplitude along the first section.

9. The hearing aid according to claim 8, wherein the parasitic antenna element has a free end opposite the parasitic antenna element excitation point, and a combined length of the first section and the parasitic antenna element corresponds substantially to a quarter wavelength of an electromagnetic radiation or any odd multiple thereof.

10. The hearing aid according to claim 1, wherein the housing has a first and second longitudinal sides, and a current flows in the first section in a direction which is substantially orthogonal to at least one of the first and second longitudinal sides of the housing.

11. The hearing aid according to claim 1, wherein the first section is a part of a supporting element, and wherein an extent of the supporting element in a direction substantially in parallel with an ear-to-ear axis of the user when the housing is worn in its operational position by the user is a quarter wavelength.

12. The hearing aid according to claim 1, wherein the first antenna element is also configured for electromagnetic field emission.

13. A method of using a first hearing aid according to claim 1 and a second hearing aid according to claim 1, comprising:

selectively placing the first hearing aid at one of a first ear and a second ear of a user; and placing the second hearing aid at the other one of the first ear and the second ear of the user.

14. A binaural hearing aid system, comprising:

a first hearing aid according to claim 1; and a second hearing aid according to claim 1;

wherein the first hearing aid may be selectively positioned at a right ear of a user or a left ear of the user, and wherein the second hearing aid may be positioned at the other ear of the user.

15. The hearing aid according to claim 1, wherein the first antenna element, the first section, and the parasitic antenna element are configured so that a total electromagnetic field emitted from the hearing aid assembly is substantially the same irrespective of whether the housing is worn in its operational position on a right hand side or a left hand side of a user.

16. The hearing aid according to claim 1, wherein the different respective planes correspond with different respective faces of the hearing aid assembly, and the at least a part of the first antenna element and the at least a part of the second antenna element are at the different respective faces of the hearing aid assembly.

17. A hearing aid comprising:

a housing; and a hearing aid assembly accommodated in the housing, the hearing aid assembly having a first antenna element configured for emission of an electromagnetic field, and a second antenna element comprising a first section and a parasitic antenna element;

wherein the first antenna element and the second antenna element are electrically separated from each other, and wherein at least a part of the first antenna element and at least a part of the parasitic antenna element lie in different respective planes that correspond with different respective faces of the hearing aid assembly that are opposite from each other.

18. The hearing aid of claim 17, wherein the first antenna element, the first section, and the parasitic antenna element are configured so that a total electromagnetic field emitted from the hearing aid assembly is substantially the same irrespective of whether the housing is worn in its operational position on a right hand side or a left hand side of a user.

19. The hearing aid of claim 17, wherein the first antenna element is closer to a first side of the hearing aid assembly than a second side of the hearing aid assembly; and wherein the parasitic antenna element is closer to the second side of the hearing aid assembly than the first side of the hearing aid assembly.

20. The hearing aid of claim 19, wherein the first side of the hearing aid assembly is opposite from the second side of the hearing aid assembly.

21. The hearing aid of claim 19, wherein a feed point for the first antenna element is closer to the first side of the hearing aid assembly than the second side of the hearing aid assembly.

22. The hearing aid of claim 17, wherein the parasitic antenna is connected to a printed circuit board or ground.

23. The hearing aid of claim 17, wherein the first antenna element, the first section, and the parasitic antenna element are configured to emit a substantially TM polarized electromagnetic wave.

24. The hearing aid according to claim 1, wherein the first antenna element and the second antenna element are electrically separated from each other in a physical sense, but are electromagnetically coupled to each other.

25. A hearing aid comprising:

a housing; and a hearing aid assembly accommodated in the housing, the hearing aid assembly having a first antenna element configured for emission of an electromagnetic field, and a second antenna element comprising a first section and a parasitic antenna element;

wherein the first antenna element and the second antenna element are galvanically separated from each other, and wherein at least a part of the first antenna element and at last a part of the second antenna element lie in different respective planes that are opposite from each other; and wherein the first antenna element, the first section, and the parasitic antenna element are configured to emit an electromagnetic wave.

* * * * *